US007077595B2

(12) United States Patent
Knight

(10) Patent No.: US 7,077,595 B2
(45) Date of Patent: Jul. 18, 2006

(54) SPINE BINDER

(75) Inventor: Colin Knight, Skokie, IL (US)

(73) Assignee: General Binding Corporation, Northbrook, IL (US)

( * ) Notice: Subject to any disclaimer, the term of this patent is extended or adjusted under 35 U.S.C. 154(b) by 0 days.

(21) Appl. No.: 10/626,753

(22) Filed: Jul. 25, 2003

(65) Prior Publication Data

US 2005/0019093 A1 Jan. 27, 2005

(51) Int. Cl.
*B42F 3/04* (2006.01)
*B42F 13/20* (2006.01)

(52) U.S. Cl. ..... 402/39; 402/20; 402/38; 402/45; 402/58; 402/60; 24/464; 281/27.1; 281/28; 281/21.1; 281/23; 412/38

(58) Field of Classification Search ..... 402/20, 402/38, 39, 45, 58, 60; 24/464; 281/27.1, 281/28, 21.1, 23; 412/38
See application file for complete search history.

(56) References Cited

U.S. PATENT DOCUMENTS

| | | | | |
|---|---|---|---|---|
| 1,816,021 | A * | 7/1931 | Meyerson | 402/36 |
| 3,205,897 | A * | 9/1965 | Jamison | 402/20 |
| 3,785,740 | A * | 1/1974 | Strong | 402/29 |
| 4,607,970 | A * | 8/1986 | Heusinkveld | 402/20 |
| 4,693,624 | A * | 9/1987 | Moosmuller | 402/22 |
| 4,904,103 | A * | 2/1990 | Im | 402/35 |
| 5,018,896 | A * | 5/1991 | Vanni | 402/38 |
| 5,393,156 | A * | 2/1995 | Mullin et al. | 402/36 |
| 5,423,624 | A * | 6/1995 | Richards | 402/13 |
| 5,782,569 | A * | 7/1998 | Mullin et al. | 402/36 |
| 6,270,280 | B1 | 8/2001 | Baumann | |
| 6,514,000 | B1 * | 2/2003 | Youngs et al. | 402/60 |
| 2002/0088098 | A1 * | 7/2002 | Bouley | 24/464 |
| 2005/0175434 | A1 * | 8/2005 | Sakata et al. | 412/38 |

FOREIGN PATENT DOCUMENTS

GB 1104022 * 2/1968

* cited by examiner

*Primary Examiner*—Boyer Ashley
*Assistant Examiner*—Mark Henderson
(74) *Attorney, Agent, or Firm*—Michael Best & Friedrich LLP

(57) ABSTRACT

The present invention provides an unitary spine binder which comprises an elongated dorsal hinge bearing pairs of opposing and complementary male and female ring elements having known male fastener and female fastener, respectively. Each pair of ring elements also comprise a concave distal end on one element, and a complementary convex distal end on the other element. When the distal ends of the ring elements are moved towards each other, the male and female fasteners reversibly engage with each other so that each pair of ring elements, in cooperation with the dorsal hinge, forms substantially a ring to secure sheet paper by occupying a pre-punched hole in the paper. At the same time, the concave and convex distal ends also engage, so that the sidewalls of the concave distal end engages the convex distal end to protect the fasteners against disengagement by torsional and lateral forces.

11 Claims, 3 Drawing Sheets

SPINE BINDER

FIELD OF THE INVENTION

The invention provides an improved unitary spine binder for removably securing a plurality of sheet paper, which allows the sheets to be easily inserted into or removed from the binder.

BACKGROUND

Different styles of binders are known to the ordinary artisan to assemble and organize documents that comprise a plurality of sheet paper. The use of any particular style depends upon the particular goal for the bound paper. U.S. Pat. No. 6,270,280 (the '280 patent) discloses a one-piece binder comprising a dorsal part having pairs of opposing fingers that reversibly snap close to form loops. The binder disclosed in the '280 patent overcame disadvantages of the prior art, because it did not require the sheet paper to be bound by specialized binding machines, and because it provided for the ability to turn a secured sheet of paper to nearly 360°. However, the relatively thin dimension of the fingers appeared to be susceptible to torsional forces that may cause the loop to pucker and accidentally disengage the fasteners. Although all of the loops are not likely to disengage at once, a disengaged loop may catch and tear paper that is being turned. Therefore, it would be desirable to provide a binder which is more resistant to torsional forces.

In addition, the '280 patent does not specifically address the number of loops used in the binder. It is now recognized that 21-hole punches are generally utilized in the European community, while 19-hole binders are generally utilized in the United States. A binder for use with 19 or 21-hole punch would be advantageous not only because it may be utilized with punches that are already generally utilized in the US and Europe, respectively, but may also consume less material than other machineless spine binders that are currently used with the 32-hole punch in the US, and the 34-hole punch in Europe.

SUMMARY OF THE INVENTION

An unitary spine binder is provided which comprises an elongated dorsal hinge along which pairs of opposing and complementary ring elements are attached. The dorsal hinge allows the ends of the pairs of opposing ring elements that are distal from the dorsal hinge to move toward or away from one another. Preferably, each ring element is wider than thick, such that a cross-section of an end of an element would resemble more of a rectangle than a square. In the case of a rounded cross-section, the present ring element would resemble more of an oval with a longer horizontal axis, rather than a circle. For each pair of ring elements, one ring element is a male element and the other ring element is a female element. At the end distal from the dorsal hinge, the male element has a male fastener. At the end distal from the dorsal hinge, the female element has a female fastener that is substantially complementary to the male fastener. When the distal ends of the ring elements are moved towards each other, the male and female fasteners reversibly engage with each other so that each pair of ring elements, in cooperation with the dorsal hinge, forms substantially a ring to secure sheet paper by occupying a pre-punched hole in the paper.

In addition, the distal end of one of each pair of fasteners also comprise a concave distal end, while the distal end of the other of each pair of fasteners also comprise a convex distal end that is substantially complementary to the concave distal surface. The two side walls of the concave distal end provide lateral support for the convex distal surface to resist torsional forces that may cause the engaged fasteners to disengage from each other.

In an embodiment, the spine binder may comprise 19 or 21 pairs of finger fasteners. In another embodiment, each finger fasteners comprise an interior slot to reduce the amount of material used, and to provide a shock absorbing capacity to the fingers. In another embodiment, the dorsal hinge comprises two hinge supports which are held in connection with one another by a thin connecting strip.

DETAILED DESCRIPTION

The invention is described by the following illustrations. It should be recognized that variations based on the inventive features disclosed herein are within the skill of the ordinary artisan, and that the scope of the invention should not be limited by the examples. To properly determine the scope of the invention, an interested party should consider the claims herein, and any equivalent thereof. In addition, all citations herein are incorporated by reference.

Figure 1:
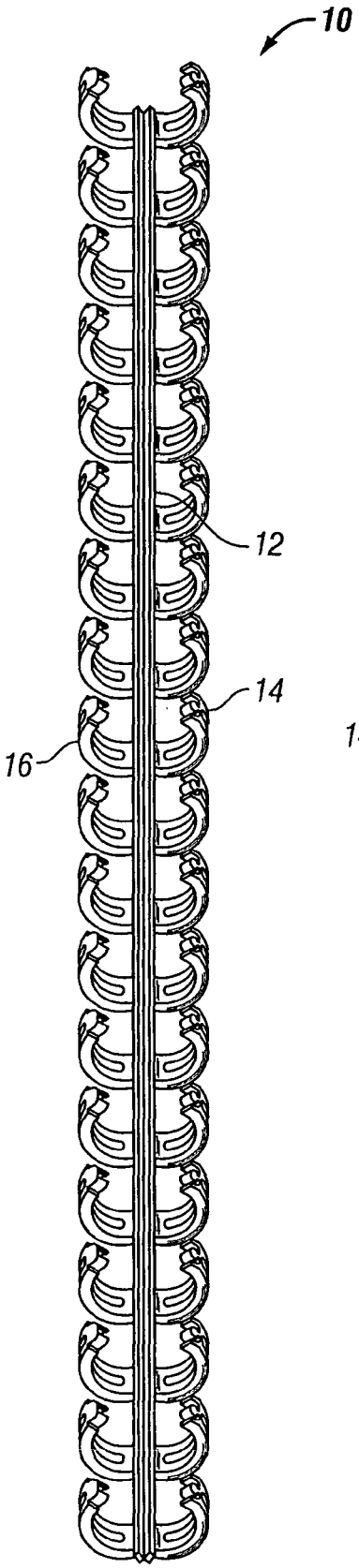
FIG. 1 is a top prospective view of a spine binder according to the present invention.

FIG. 1 provides a prospective view of an embodiment of a spine binder 10 according to the invention. Spine binder 10 comprises a dorsal hinge 12 bearing a plurality of opposing and complementary pairs of male ring elements 14 and female ring elements 16. In the particular illustration of FIG. 1, 19 pairs of ring elements are shown to conform with paper that is punched by a 19-hole punch. However, the number of pairs of ring elements can vary according to the needs of the user. Moreover, although shown as substantially semicircles, the ring elements need not have the same circular arc, so long as they form substantially a loop in cooperation with the hinge when closed. The ring elements can also form other shapes, such as, for example a substantially D-shaped loop.

Figure 2:
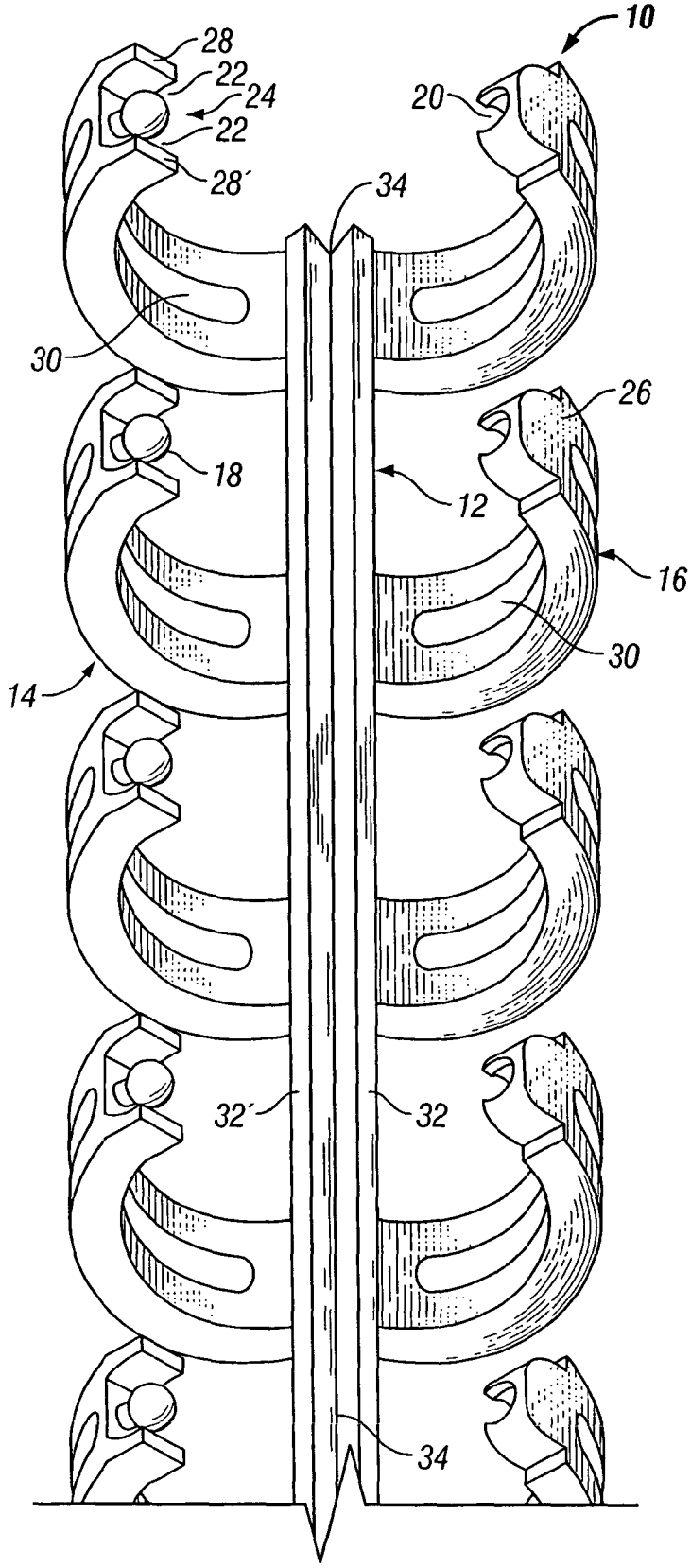
FIG. 2 is a top close-up view of the ring elements according to the present invention.
Figure 3:
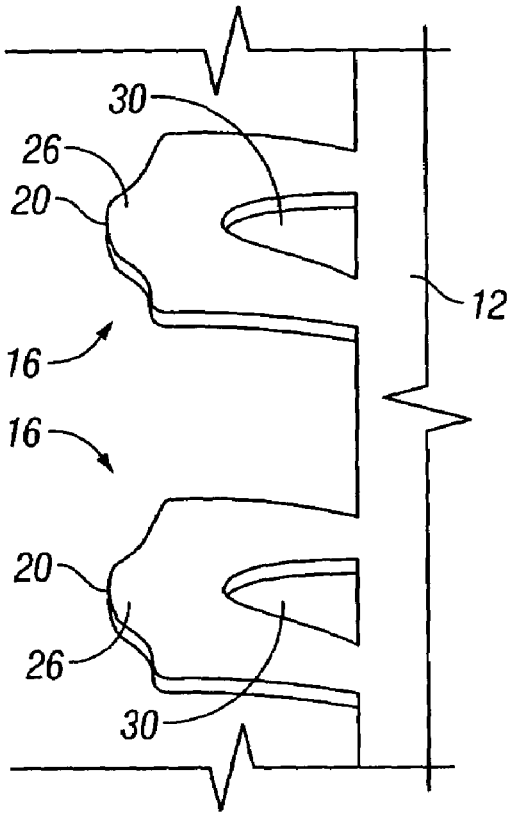
FIG. 3 is a close-up view of female elements according to the present invention.
Figure 4:
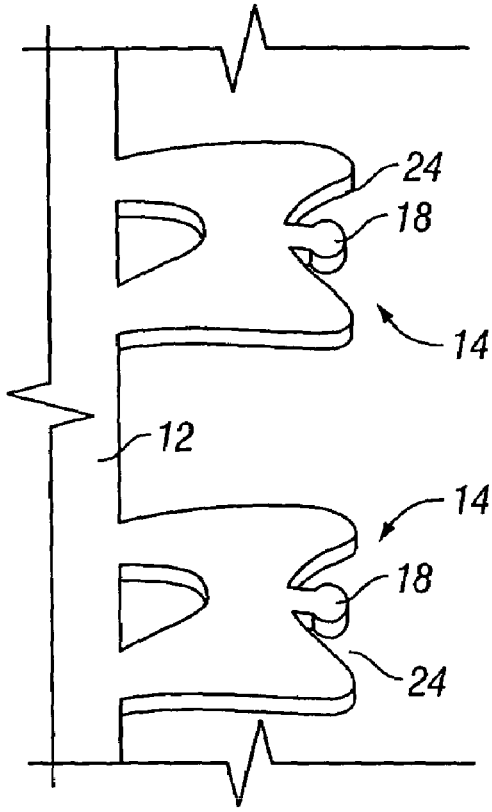
FIG. 4 is a close-up view of male elements according to the present invention.

As shown in FIG. 2, male ring element 14 comprises male fastener 18 (see also FIG. 4), while female ring element 16 comprises female fastener 20 (see also FIG. 3). Further, the elements also comprise either a concave distal end 24 or a convex distal end 26. The concave distal end comprises two side-walls 28 and 28' which define an end recess 22, that is complementary to convex distal end 26. Although the concave distal end 24 is shown on the male ring element 14 with the male fastener 18 residing in recess 22, and the convex distal end 26 is shown on the female ring element 16, the structures can be reversed so that the male fastener is on the convex distal end, while the female fastener is on the concave distal end (not shown).

FIG. 2 also shows the dorsal hinge 12, with two hinge braces 32 and 32', and a connecting strip 34. In an embodiment, hinge 12 is pre-folded so that hinge braces 32 and 32' are configured at less than 180° on the side from which the ring elements protrude. Hinge 12 opens when hinge braces 32 and 32' are separated, and closes when hinge braces 32 and 32' are brought together. It should be noted that in the embodiment shown in FIG. 8, braces 32 and 32' are shaped at the attachment to hinge 34 to so that clearance to separate the braces by greater than 180 degree is provided. This provides a particularly wide opening for inserting papers into the binder.

In addition, to reduce the amount of material required to make the spine binder, an optional interior slot 30 is shown for each ring element. Moreover, interior slot 30 is further optionally made to provide sufficient flexibility to the finger, such that when the loop is closed, any stress against the loop is absorbed by the section having the interior slot 30 rather than by disengaging the fasteners. Examples of such stress occur when weight in the form of a book is laid upon the binder, or when a torsional force is applied by turning a large number of pages.

Figure 5:
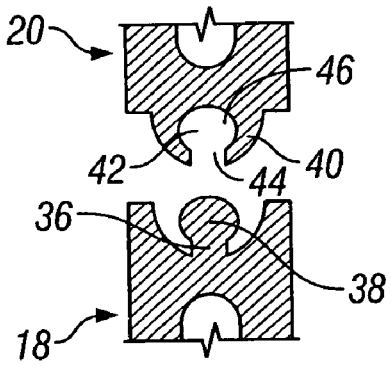
FIG. 5 is a top-down cross-sectional view of the distal end of a pair of ring elements according to the present invention, wherein the fasteners are not engaged.
Figure 6:
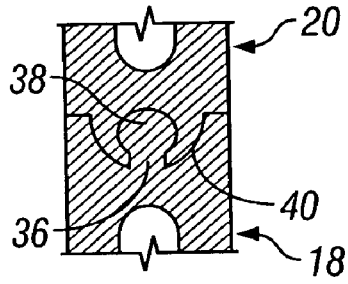
FIG. 6 is a top-down cross-sectional view of the distal end of a pair of ring elements according to the present invention, wherein the fasteners are engaged.

FIGS. 5 and 6 are horizontal cross-sectional views that illustrate preferred fasteners 18 and 20, in their respective open and closed positions. Male fastener 18 comprises a neck 36 and a head 38. The thickness of head 38 is greater than the thickness of neck 36. Female fastener 20 comprises fastener wall 40 that define a fastener recess 42 having a channel 44 and a head cavity 46. Fastener recess 42 is tightly complementary to the head 38 at the head cavity 46, and to the neck 36 at channel 44. In an embodiment, fastener wall 40 is sufficiently pliable for a even a non-pliable head 38 to pass through the channel 44 with the application of an external force, but is sufficiently rigid so that once head 38 is enclosed in head cavity 46, it is not disengaged from the recess without the application of an external force. In another embodiment, head 38 can also be sufficiently pliable to fit into and out of fastener recess 42, through channel 44, even if fastener wall 40 is not pliable. In the latter case, head 38 must be sufficiently rigid that it cannot pass through channel 44 without the application of an external force. In another embodiment, both head 38 and fastener wall 40 are sufficiently pliable to allow head 38 to pass through channel 44 with the application of an external force, but also sufficiently rigid so that head 38 would not pass through channel 44 without an external force. The male fastener and female fasteners are engaged and disengaged by the application of an external force by passing head 38 into and out of fastener recess 42. While the head and neck and the recess are shown as spheres, other polygonal shapes, such as quadrangles are also contemplated.

Figure 7:
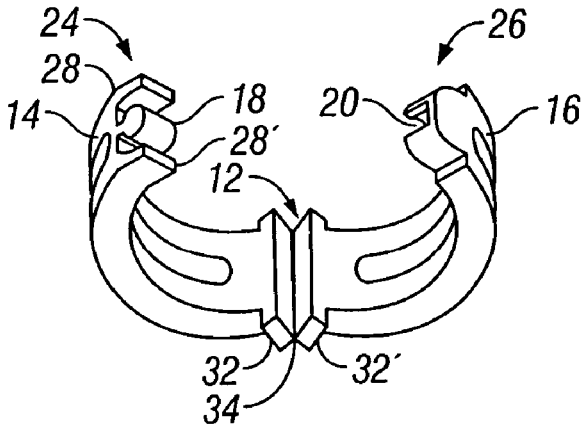
FIG. 7 is an end prospective view of a ring element according to the present invention wherein the fasteners are not engaged.
Figure 8:
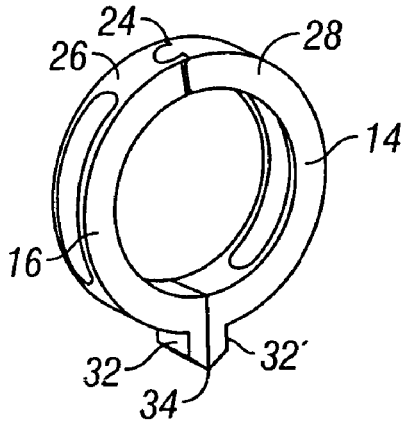
FIG. 8 is a end prospective view of a ring element according to the present invention wherein the fasteners are engaged.

FIGS. 7 and 8 illustrate the operation of the ring elements in a open configuration and a closed configuration, respectively. Note that not only does the male and female fasteners complement each other, but that the concave distal end and the convex distal end also complement each other. When the ring elements are engaged the two distal ends are joined so that the exterior surfaces are substantially flush against each other, and sidewalls 28 and 28' form supports against convex distal end 26 to keep lateral and torsional forces from disengaging the fasteners. Note that the convex and concave distal ends need not have any particular shape. In FIGS. 2 and 7, the concave and convex surfaces take a more polygonal shape, while in FIGS. 3 to 6, the shape is more rounded shape.

The spine binder are made by methods known to the ordinary artisan. Some examples of such methods include injection molding, stamping and extrusion. The materials used are preferably polymers. However, other materials, such as metal, are also known for making binders.

I claim:

1. A unitary injection molded polymeric spine binder comprising:

a spine consisting of a longitudinally extending connecting strip, a series of spaced apart hinge members on said spine, each said member defining a hinge consisting of longitudinally extending portions arranged transverse to said spine joined together centrally of their width along one common longitudinal edge of said spine, each said member having:

a ring arranged substantially transverse to said spine to define an elongated dorsal hinge comprising a first hinge brace and a second hinge brace connected by said spine, so that the hinge is open when the hinge braces are separated, and the hinge is closed when the hinge braces are brought together; and a plurality of complementary male and female ring elements, wherein each ring element is a semicircle and comprises a proximal end attached to a hinge brace and a distal end comprising a male fastener for a male ring element and a female fastener that is complementary to the male fastener for a female ring element, each ring element being attached to one hinge brace and a complementary ring element being attached to the opposing hinge brace, so that the distal ends of the complementary ring elements are separated when the hinge is open, and are engaged to form a loop in cooperation with the hinge when the hinge is closed and said hinge braces are arranged face to face extending beyond a plane of said elements, each of said rings having a slot spaced apart from its ends, and wherein said hinge members of said series are spaced apart along said spine a distance less than the circumference of said ring and are pressed together into removably secured engagement when pressure is applied to said spine.

2. The spine binder according to claim 1, wherein the male fastener has a side wall surrounding it which receives the female fastener.

3. The spine binder according to claim 1, wherein the ring elements are wider than thick.

4. The spine binder according to claim 1 wherein said slot on each ring element further comprises a closed interior slot within the walls of each said ring element.

5. The spine binder according to claim 1, wherein said female fastener has an open side for receiving the male fastener therein.

6. The spine binder according to claim 1, wherein the male and female ring elements are interspersed on both hinge braces.

7. The spine binder recited in claim 1, wherein all of said hinge member of said series may be closed together to form a loop upon manipulation of said spine.

8. The spine binder recited in claim 4 wherein said slot extends substantially more than half the length of said ring element.

9. The spine binder received in claim 6, wherein such pressure is applied to said spine from the direction of said fasteners.

10. A spine binder comprising:

a spine consisting of a longitudinally extending strip, a series of spaced apart hinge members on said spine, each said member being transverse to said spine and defining a hinge consisting of longitudinally extending hinge braces joined together centrally of their width along one common longitudinal edge of said spine to define a loop when closed, each said member having:

a first hinge brace and a second hinge brace connected by said spine, such that when the hinge is open said hinge braces are separated, and the hinge is closed when the hinge braces are brought together; and complementary male and female ring elements, wherein each ring element have a proximal end attached to a hinge brace and a distal end comprising a male fastener for a male ring clement and a female fastener complementary to the male fastener for a female ring element, each ring element having a male fastener being attached to one hinge brace and a complementary ring element having a female ring element attached to the opposing hinge brace, such that the distal end of the ring element are separated when the hinge is open, and are engaged to form a loop in cooperation with the hinge when the hinge is closed, and wherein the distal ends of said ring element nest so that the female fastener surrounds the male fastener and the male fastener is engaged within and has a wall surrounding the female fastener;

wherein each ring element has an interior slot extending substantially more than half a length of and through said ring element, and said ring elements are pressed together into removably secured engagement when pressure is applied to the web of said spine, wherein said male and female ring elements are drawn apart to open the binder to permit reloading of a sheet and closed again by bringing said elements together.

11. A unitary injection molded polymeric spine binder comprising:

a spine consisting of a longitudinally extending connecting strip, a series of spaced apart hinge members on said spine, each said member defining a hinge consisting of longitudinally extending portions arranged transverse to said spin joined together centrally of their width along one common longitudinal edge of said spine, each said member having:

a ring arranged substantially transverse to said spine to define an elongated dorsal hinge comprising a first hinge brace and a second hinge brace connected by said spine, so that the hinge is open when the hinge braces are separated, and the hinge is closed when the hinge braces are brought together; and a plurality of complementary male and female ring elements, wherein each ring element is a semicircle and comprises a proximal end attached to a hinge brace and a distal end comprising a male fastener for a male ring element and a female fastener that is complementary to the male fastener for a female ring element, each ring element being attached to one hinge brace and a complementary ring element being attached to the opposing hinge brace, so that the distal ends of the complementary ring elements are separated when the hinge is open, and are engaged to form a loop in cooperation with the hinge when the hinge is closed and said hinge braces are arranged face to face extending beyond a plane of said ring elements, wherein said hinge members of said series are spaced apart along said spine a distance less than the circumference of said ring and are pressed together into removably secured engagement when pressure is applied to said spine.

* * * * *